United States Patent [19]

Summer

[11] Patent Number: 4,929,873

[45] Date of Patent: May 29, 1990

[54] LUMINAIRE SYSTEM

[75] Inventor: Steven E. Summer, Setauket, N.Y.

[73] Assignee: Powr-Ups Corporation, Bohemia, N.Y.

[21] Appl. No.: 203,077

[22] Filed: Jun. 6, 1988

[51] Int. Cl.[5] ..... H05B 37/02

[52] U.S. Cl. ..... 315/219; 315/DIG. 5; 315/291; 362/190

[58] Field of Search ..... 315/76, 209 R, 219, 315/291, DIG. 5; 362/3, 9, 190, 191, 194, 368, 370, 371, 413, 414, 431

[56] References Cited

U.S. PATENT DOCUMENTS 4,232,357 11/1980 Dietz ..... 362/191 X 4,796,172 1/1989 Chestnut ..... 362/431 X

*Primary Examiner*—Robert J. Pascal

*Attorney, Agent, or Firm*—Stephen E. Feldman

[57] ABSTRACT

A portable high pressure sodium lamp lighting system is mounted on a mobile cart, the cart carrying a mobile power supply in the form of an automotive type battery. The portable lighting system employs a standard high pressure sodium luminaire designed to be driven by 115 volt 60 cycle utility generated power. A DC to AC converter is employed which converts the DC battery supply to a 115 volt simulated 60 cycle supply. The AC characteristic is simulated by generating a quasi-square wave form which approximates a 60 cycle characteristic when driving the luminaire.

4 Claims, 3 Drawing Sheets

HPS LUMINAIRE
12 VDC TO 115 VAC AT SIMULATED 60 HZ CONVERTER
BATTERY

LUMINAIRE SYSTEM

BACKGROUND OF THE INVENTION

The present invention relates to ionization illumination systems and particularly to a high pressure sodium (HPS) illumination system.

It is well known to have lamp or luminaire systems in which the luminaire element contains a gas which may be ionized by electric excitation and when the luminaire is electrically excited, the ionized gas provides illumination. One of the disadvantages of ionization illumination, as opposed to incandescent lamp illumination or illumination from light emitting diodes (LED's), is that a relatively high voltage is required to initially excite the gaseous element into ionization so as to produce illumination. However a great advantage of ionization illumination over incandescent lamp illumination is that after the luminaire element is electrically excited into an illuminated state a relatively very small amount of continuing alternating power is required to produce a relatively large amount of light output.

High pressure sodium lamps are combined with starting circuitry, ballasting circuitry, sockets and reflectors into assemblies called luminaires, These luminaires or lighting systems are particularly designed to be excited into a state of ionized illumination by normal 110–120 volt alternating current which is a 60 Hertz or cycle current.

A start up circuit is normally part of the lighting system. The start up circuit, which is connected to the 110–120 AC supply, provides high voltage pulses to the lamp to excite the gas into an ionized state. After such state is attained the start up circuit becomes dorment in favor of application to the luminaire of a substantially low AC voltage required to maintain ionization of the gaseous element. It has been found that 60 Hertz power of relatively low current per unit illumination may be used to maintain ionization. The ballasting circuit controls the amount of power drawn by the high pressure sodium lamp after the arc has been established by the starting circuit.

This provides a large amount of lumens obtained from the amount of electricity used to keep the luminaire in a state of illumination, thus providing relatively energy efficient illumination.

Commercially produced high pressure sodium luminaires have been designed to operate from standard 115 volt 60 Hertz alternating current, which is normal utility power in the United States of America. However, the availability of utility power is usually limited in many applications requiring portable or emergency lighting. This limited distribution of utility power limits the use of high energy efficiency HPS luminaire systems unless an alternate source of power is provided.

SUMMARY OF THE INVENTION

The present invention is a portable high pressure sodium lighting system that includes its own source of power, independent from utility power. A high pressure sodium luminaire is mounted on top of a mast, which mast is mounted on a roll about cart, which cart carries a source of power in the form of a battery, for example. Preferably the battery is a 12 volt automotive type battery which, after a period of use may be charged with a standard battery charger driven from a 115 volt alternating current (115 VAC) source, such as a utility power supply.

The high pressure sodium lighting system includes a direct current (DC) to alternating current (AC) converter circuit which converts the 12 volt direct current (12 VDC) to 115 VAC in which the alternating current characteristic of the utility power is simulated. The ideal wave form generated by an inverter or DC to AC converter is a sine wave, as this wave form is the basis of the design assumption for the normal power factor for the HPS luminaire. However, the present invention provides for the DC to AC conversion of a electrical quasi-square wave, which sufficiently simulates the sine wave power provided by utility power. The DC to AC inverter is driven by the DC source and generates square waves by starting from two or three valued wave forms, multiplying these wave forms to a predetermined value and filtering the predetermined value to obtain a quasi-square wave voltage having 60 cycle characteristics which presents a very low source impedance to the HPS lamp ballast load. The quasi-square wave is a symmetrical square wave with 60 degrees of zero voltage and 120 degrees of full voltage for each half cycle. Preferably the quasi-square wave contains no triplen harmonics so that a very close approximation of a sine wave is provided. It is believed that such quasi-square wave is a closer approximation of a sine wave than a square wave would be. In addition, the use of a quasi-square wave is a very good approximation to a sine wave for purposes of providing a satisfactory wave form for driving a commercial HPS luminaire with maximum economy.

When the HPS luminaire is de-energized, that is, in a state of non-illumination, the lamp has a high impedance. In order to excite the gas inside the envelope of the HPS lamp into ionization, high voltage pulses are applied to the lamp input. AC power applied to a series connected circuit of an inductor and the HPS lamp provides the high voltage pulses required for ionization. When the gas contained in the envelope is sufficiently ionized, the arc ignites between terminals of the lamp and conduction is stablilized at an operating point established by the ballast inductor.

The power required by commercially available HPS lamps and the series connected ballasting element varies from close to zero when the lamp is de-energized to full load power when the lamp is energized and in an ionized or illuminated state. In addition, the load presented by the luminaire is highly reactive, that is, having a low power factor. Commercial HPS lamps are designed so that proper operation of the lamp depends on driving the lamp with a sinusoidal or sinusoidal-like wave shape at approximately 60 Hertz or cycles at a voltage of approximately 115 volts. The wave form must be maintained even though the low power factor causes reactive current flow back through the inverter.

By providing the quasi-square wave described above across the input terminals of the luminaire it is possible to make use of standard 115 VAC power line operated luminaires in a portable high pressure sodium lighting system, resulting in a low product cost.

OBJECTS OF THE INVENTION

It is an object of the invention to provide a portable high pressure sodium lighting system operating from a standard automotive type 12 volt battery using a standard 115 VAC power line operated high pressure sodium luminaire, said system producing a relatively large amount of light for a relatively long period of time without requiring recharging of the batteries.

Another object is to provide an economical drive circuit for a standard 115 VAC power line operated high pressure sodium luminaire in which a standard automotive type battery is used to drive the circuit which converts the 12 VDC power into a 115 VAC characterized by a quasi-square wave that approximates a symmetical square wave with 60 degrees of zero voltage and 120 degrees of full voltage per half cycle wave, said waveform being maintained despite the highly reactive current flow characteristics of the luminaire.

These and other objects will become apparent when reading the following description of the invention with reference to the accompany drawings in which:

DETAILED DISCLOSURE OF THE INVENTION

Figures 1, 1A, 2:
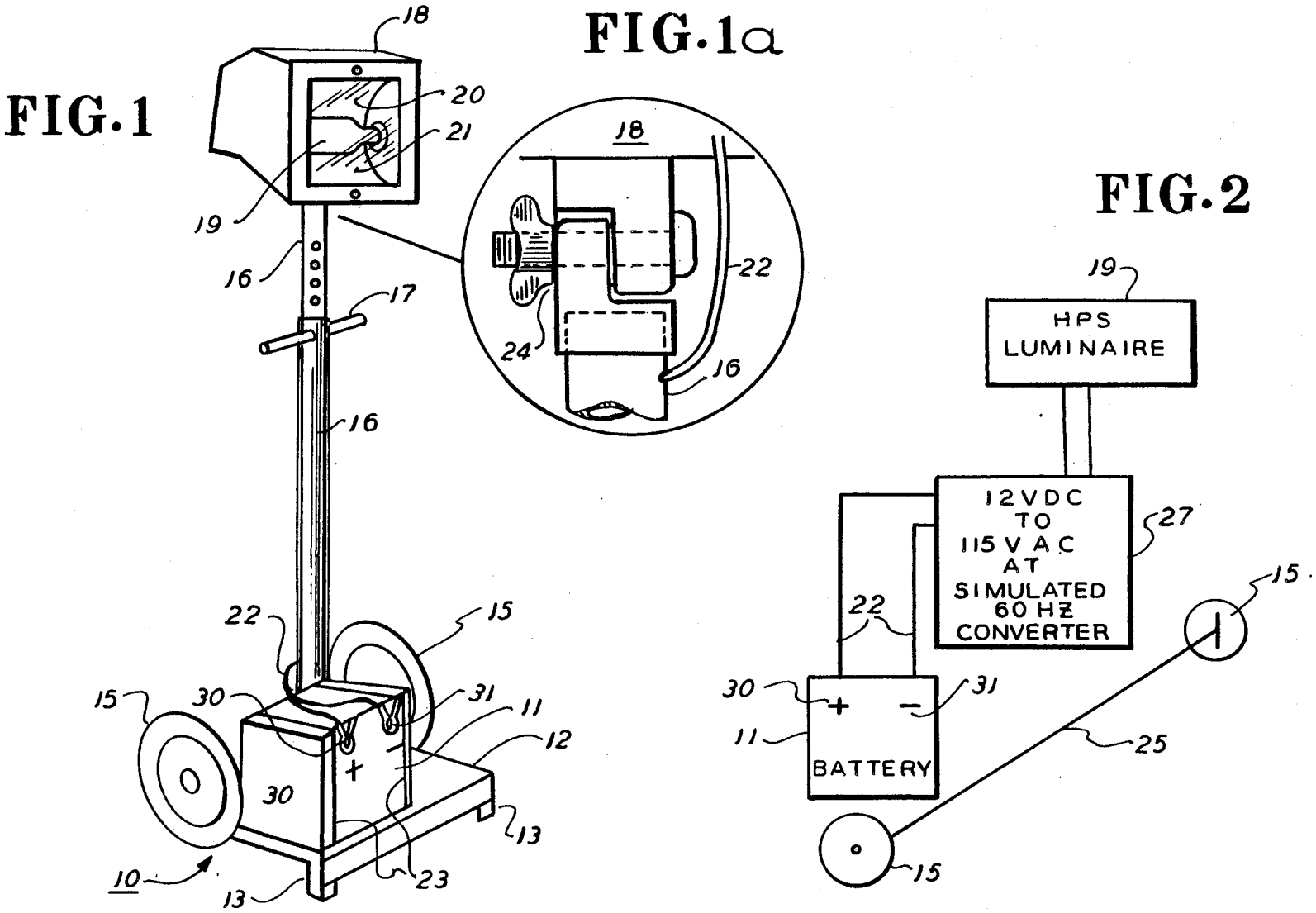
FIG. 1 is a pictorial illustration of the portable high pressure sodium lamp lighting system.
FIG. 1*a* is a pictorial illustration of an adjustable coupling.
FIG. 2 is a block diagram of the system.

FIG. 1 illustrates in a pictorial view a preferred form of the portable high pressure sodium lighting system. This self contained system includes a two-wheel cart 10 with a battery 11 secured to the platform 12 of the cart. Forwardly located feet 13 function in conjunction with the wheels 15 to keep the cart level. A mast 16 is represented in telescoped form, adjustable by removal of the pin 17 so that the two piece mast may be extended to raise the lamp housing 18. A high pressure sodium (HPS) lamp 19 is retained in the lamp housing forward of the reflector 20 and enclosed by the removable cover or lens 21. The lens 21 is a clear material such as glass or plastic.

The battery 11 includes two terminals + and − to which wires or cables are connected. The cables 22 enter the hollow mast and follow to the interior of the lamp housing which supports the circuitry (not seen) of the lighting system. Straps 23 secure the battery to the platform of the cart.

The cables 22 may be mounted on the outside of the mast 16 or may be fed into the hollow of the mast, at or some what above the platform and tunnelled through the telescopic mast to the lamp housing. The lamp housing 18 is connected to the mast 16 by an adjustable clamp shown in FIG. 1*a* so that the angle at which the lamp housing may be directed is adjustable vertically. Although the cart is easily positionable for horizontal adjustment of the lamp housing the mast is secured within an adjustable clamp that permits rotation of the mast for more precise horizontal positioning and directing of the light produced within the housing.

The mast may be grasped and pulled backwards, pivoting on the axial passing through the wheels. The platform will follow, pivotting on the axial and the entire lighting system may be easily moved. Lengthening and shortening of the mast may be easily accomplished by removing the pin 17 and aligning the holes in the upper and lower tubes of the mast. By inserting the pin 17 through the aligned holes the length of the mast is established.

Figure 3:
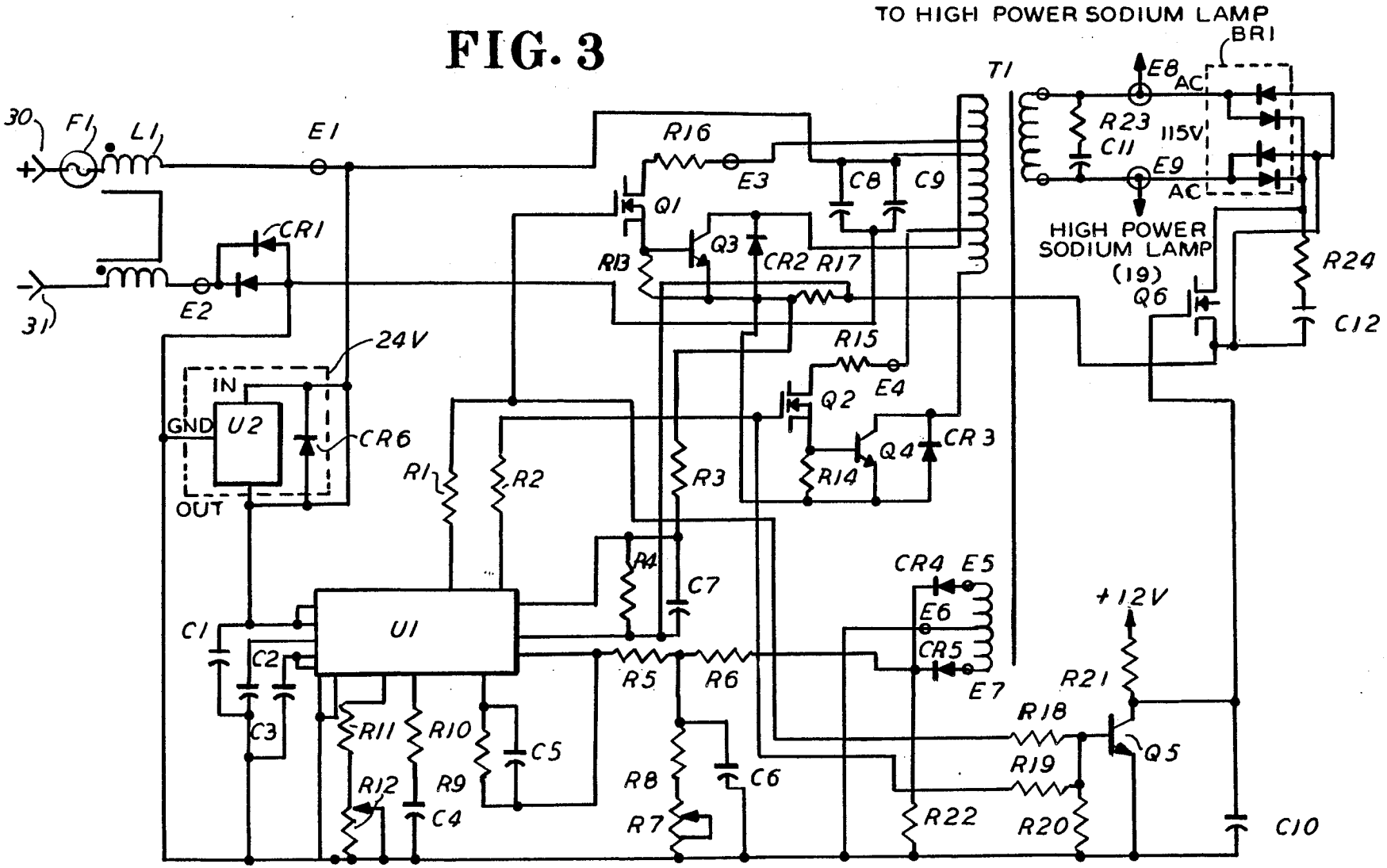
FIG. 3 is a circuit diagram of the drive or illumination sustaining circuit of the portable high pressure sodium lamp lighting system. and, FIG. 3*a* is a circuit diagram of a starting circuit for driving the high pressure sodium lamp to illumination.

FIG. 2 is a block diagram of the portable lighting system where the wheels 15 are represented secured to an axial 25. The battery 11, as will be explained with reference to the circuit diagram of FIG. 3, is preferably a 12 volt, standard automotive type battery. It may however, be a larger than standard size, if desired or may be a 24 volt system, if desired. Cables 22 couple the terminals of the battery to the input terminals of the circuit, represented by block 27. The output of the inverter or converter is applied to the high pressure sodium lamp.

Preferrably the cables 22 include two clamps for securing the cables individually to the terminals of the battery. The clamps add interchangeability to the power supply system. Preferrably the clamps are standard battery terminal clamps and are conveniently and easily removable from the terminals of the battery.

Referring to FIG. 3, a circuit diagram of the illumination sustaining circuit of the HPS lighting system is shown in which either a 12 volt DC supply or a 24 volt DC supply may be used.

DC power is applied to the terminals 30 and 31, the positive or plus and negative or minus terminals respectively of the battery. The positive supply is fed through a fuse F1 and an interference suppression inductor LI to energy storage capacitors C8 and C9 . The rectifier CR1 in the negative supply prevents damage due to reversed input polarity.

A push-pull inverter stage including two power stages driving a center tapped step up transformer T1, generates a basic AC wave form. Each half of the push-pull stage is designed to switch peak currents as high as 40 amperes with minimum voltage drop. One of the two identical stages consists of power field effect transistor driver Q1, main power transistor Q3, reverse rectifier CR2 , base-emitter shunt resistor R13 and base drive limiting resistor R16. Resistor R16 is connected to a tap on the power transformer coil allowing main power transistor Q3 to fully saturate. The mirror image stage includes field effect transistor Q2 and power transistor Q4 , reverse rectifier CR3 , base-emitter shunt resistor R14 and base drive limiting resistor R15.

The instantaneous current in the respective switching stage is sampled by resistor R17.

Each push-pull stage alternately conducts for 120 degrees out of each 360 degrees. During the two remaining 60 degree intervals, both push-pull switches open and the output of main power transformer T1 is shorted by power field effect transistor Q6.

A four rectifier bridge circuit BR1 steers the output voltage from T1 so that the polarity presented to FET Q6 is always positive. Snubber networks R23/C11 and R24/C12 reduce the amplitude of voltage spikes and trancients to safe levels.

The inverter power stage described allows the efficient production of a quasi-square wave voltage while presenting a very low source impedance to the high pressure sodium lamp ballast load. During the on interval of either push-pull stage forward current is provided by the battery while reactive current is circulated into the energy storage capacitors. During the two 60 degree intervals when both push-pull stages are off, circulating current is passed through the shorting stage consisting of the power FET Q6 and bridge BR 1. The shorting winding is past the secondary of the power transformer. This eliminates the need for the shorting current to flow through the secondary winding raising the overall efficiency of the circuit.

Since galvanic isolation between the HPS luminaire and the battery is not required, the source of power FET Q6 is referenced to the circuit common, resulting in circuit simplification.

The power stage of the circuit generates the quasi-square waveform with a very low source impedance, assuring that the waveform applied to the HPS luminaire is not distorted by the high inductive circulating current during the period of illumination. This allows the production of a constant light output as the battery voltage falls during the discharge interval.

The voltage regulator U2 is provided for use with a 24 volt battery. The voltage regulator and diode CR 6 are shown within a broken line box 24V. Also the resistor R24 and series connected capacitor C12 and the series network of resistor R23 and capacitor Cll are each shown in a broken line box 24V. The broken line box 24V indicates that this circuitry is used only when the battery source is a 24 volt source.

The integrated circuit chip U1 generates the quasi-square wave form for driving the luminaire. The capacitor C2 determines the rate of soft start at power application. Resistors R10, R11 and R12 and capacitor C4 determine the frequency of the wave-form which is normally set at 60 Hz. Voltage feedback from a secondary transformer winding is recified by diodes CR4 and CR5 and applied to an RC feedback network to regulate the average output amplified by variation of the pulse width. Resistor R7 is a variable resistor and is used to adjust the pulse width to a quasisquare wave at normal load and imput voltage. Resistors R18, R19, R20 and R21 in conjunction with transistor Q5 generate the drive signal to output shorting transistor Q6. Capacitor C10 delays the drive signal to Q6 to allow power transistors Q3 and Q4 to turn off prior to shorting the output winding.

Figure 3A:
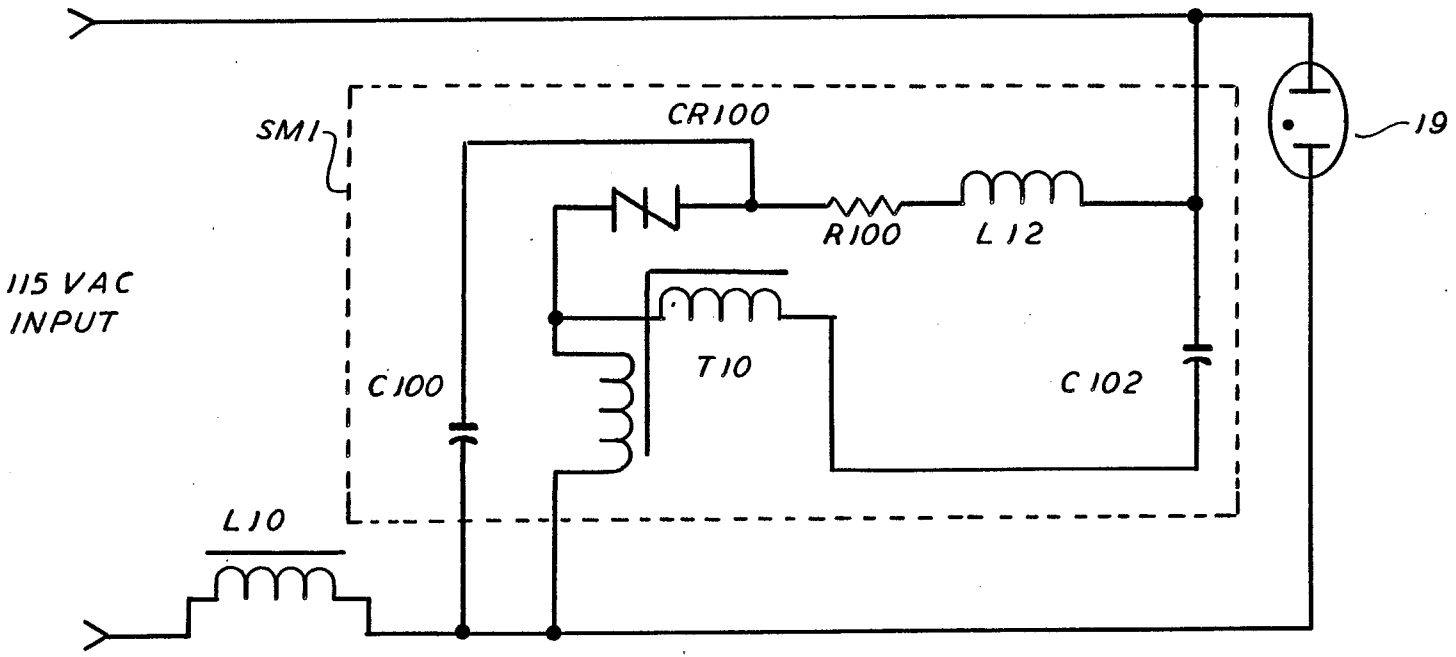

The start-up circuit for providing the high voltage pulses to drive the luminaire to an illuminated condition is shown in circuit form in FIG. 3*a*.

The alternating current output of the drive circuit of FIG. 3 is applied to the input of the start-up circuit which includes a ballast inductor L10 in series connection with the HPS lamp 19. When the lamp is deenergized it has a high impedance. The gas inside the envelope of the HPS luminaire is ionized by application of high voltage pulses. When the gas is sufficiently ionized, the arc ignites and is stabilized at an operating point by the ballast inductor L10.

The starting module of the start up circuit is shown in a broken line box SM1 . The alternating current is applied through inductor L12, Resistor R100 to the junction of the bi-lateral break-over diode CR100 and decoupling capacitor C100. When the voltage at this junction exceeds the break down voltage of the AC diode CR100, which is preferably approximately 112 volts peak, the diode abruptly avalanches into conduction and applies a sharp pulse to step-up transformer T10. Capacitor C102 couples the transformer increased pulse to the arc lamp. Inductor L12 decouples the pulse from the relatively low impedance of resistor R100 and capacitor C100.

The starting module generates pulses each half cycle until the arc is sustained in the envelope of the luminaire and ionization takes place. Upon ionization the low voltage drop across the HPS arc lamp starves the starting module so that no further starting pulses are generated. Illumination of the luminaire is then sustained by the drive circuit.

Thus a preferred embodiment of the present invention has been illustrated and described and the preferred embodiment of the drive circuit has been shown in schematic circuit form and described, along with a schematic circuit and description of a starting circuit with starting module. Although not illustrated or indicated a switch may be inserted in the direct current power source line, if desired. Preferably the switch would be a heavy duty switch. Other changes and/or modifications may be made as will become apparent to those skilled in the art without departing from the invention as defined in the claims.

What is claimed is:

1. A high pressure sodium lamp lighting system having portable characteristics, said system including
   (a) a portable power supply providing at least 12 volts direct current;
   (b) means for converting said portable power supply into an alternating current power supply providing a voltage level of at least 115 volts, said alternating current characterized by a symmetrical quasi-square wave with 60 degrees of zero voltage and 120 degrees of full voltage per half cyle;
   (c) mean for applying said alternating current power supply to a starting circuit said starting circuit connected to a high pressure sodium lamp including an envelope containing gas and two spaced apart terminals, said gas adapted to be ionized by high voltage pulses applied to at least one terminal of said two spaced apart terminals; and,
   (d) means for applying said symmetrical quasi-square wave supply across said two spaced apart terminals of said high pressure sodium lamp for maintaining said lamp in an ionized state after said gas is ionized by said high voltage pulses.

2. A high pressure sodium lamp lighting system as in claim 1 and in which said portable power supply is a battery and said system further includes:
   (a) at least a pair of spaced wheels mounted on a common axial; and
   (b) a platform between said spaced wheels supported by said common axial and supporting said battery.

3. A high pressure sodium lamp lighting system as in claim 2 and in which said system further includes
   (a) a housing for mounting said high pressure sodium lamp therein; and,
   (b) mast means connected to said platform and said housing for supporting said housing above said platform when said platform is in a standing position.

4. A high pressure sodium lamp lighting system as in claim 3 and in which said means for converting is located in said housing and said system further includes
   (a) a cable means coupled between an input of said means for converting and output terminals of said battery, said cable means extending along said mast means.

* * * * *